United States Patent [19]

Walker

[11] Patent Number: 4,889,341

[45] Date of Patent: Dec. 26, 1989

[54] GOLF SWING ANALYZER

[76] Inventor: Grant W. Walker, 8830 Madison, Fair Oaks, Calif. 95628

[21] Appl. No.: 284,723

[22] Filed: Dec. 15, 1988

[51] Int. Cl.[4] ..... A63B 69/36

[52] U.S. Cl. ..... 273/176 F; 273/185 R; 273/181 K

[58] Field of Search ..... 273/176 F, 176 FA, 176 FB, 273/176 K, 176 L, 181 K, 181 R, 181 B, 182 R, 182 A, 184 R, 185 R, 183 R

[56] References Cited

U.S. PATENT DOCUMENTS

| | | | |
|---|---|---|---|
| 702,828 | 6/1902 | Smith | 273/181 K |
| 1,657,913 | 1/1928 | Barnett | 273/181 K |
| 1,989,542 | 1/1935 | Botthman | 273/182 R |
| 2,011,014 | 8/1935 | Rosengarten | 273/181 B |
| 3,128,627 | 4/1964 | Harris | 273/181 K |
| 3,311,377 | 3/1967 | Holbus | 273/186 |
| 3,328,033 | 6/1967 | Hendry | 273/182 |
| 3,469,454 | 9/1969 | Cornell | 273/181 K |
| 3,516,675 | 6/1970 | Kuester et al. | 273/181 K |
| 3,524,649 | 8/1970 | Conklin et al. | 273/181 K |
| 3,558,140 | 1/1971 | Romeo | 273/181 |
| 3,601,406 | 8/1971 | Guisti | 273/176 G |
| 3,684,293 | 8/1972 | Brooks | 273/176 F |
| 4,596,392 | 6/1986 | Walker | 273/183 C |

*Primary Examiner*—George J. Marlo
*Attorney, Agent, or Firm*—Joseph E. Gerber

[57] ABSTRACT

A golf swing analyzer is disclosed having, in combination, a teeing area with a teeing mat, foot planting mat and ball tee, a rigid, upstanding target board placed a short distance from the teeting area and rebound board disposed horizontally in front of the target board for receiving the rebound of a practice ball off the target board. This swing analyzer is used by driving a powder carrying, resilient, yet energy-absorbing, practice ball against the target board from the tee. The accuracy of the shot and the spin put on the ball are determined by analysis of the powder marks left on the target and rebound boards.

20 Claims, 5 Drawing Sheets

GOLF SWING ANALYZER

BACKGROUND OF THE INVENTION

1. Field Of The Invention

The present invention relates generally to golf practice devices, and more specifically to such devices employing a tee from which a golf ball is driven toward a backstop, the backstop bearing indicia from which performance of a practicing golfer may be determined.

2. Description Of The Related Art

Professional and amateur golfers alike agree that mastery of the game of golf requires diligent practice of one's swing, preferably accompanied by competent instruction. Unfortunately, during normal practice and play professional analysis of one's technique and appropriate remedial guidance is often unavailable. Further, since golf is an outdoor game, foul weather and darkness sometimes limit the hours one may practice.

To address golfers' needs for quality practice time, and practice unhindered by the elements, various golf simulation devices have been devised. Many constitute little more than a game reminiscent of golf and fail to provide constructive feedback on the player's technique other than some indication of the accuracy of a shot. For example, U.S. Pat. No. 3,328,033 to Hendry discloses a tiltable target that catches golf balls from various angles of trajectory; U.S. Pat. No. 3,601,406 to Guisti employs a self-adhering practice ball which is driven toward a fabric target; and, U.S. Pat. No. 3,558,140 to Romeo shows a fabric target having slits therein through which a golf ball may pass when hit accurately.

Another class of devices does allow one to conduct some self-analysis of one's swing, thereby permitting enjoyment of the feedback on technique normally received during personal instruction. Examples of such devices include that disclosed in U.S. Pat. No. 3,311,377 to Holbus wherein a marker is affixed to a golf club to trace one's swing path, and U.S. Pat. No. 3,684,293 to Brooks which discloses a netted cage with rebound strips on its back wall and ceiling from which the velocity and spin of an impacting golf ball may be estimated. However, such devices fail to offer the practicing golfer the ability to execute a full power swing, and thereafter to calculate with some precision the accuracy and spin of the shot, from temporary marks susceptible to simple analysis.

There also exists a type of practice apparatus mainly comprised of walls and a ceiling of netting completely surrounding a practicing golfer. Some indicia from which a golfer may calculate accuracy of a full power swing at a conventional golf ball may also be included. However, such setups require considerable investments for netting material and floor space. Further, calculation of the spin on a ball is made very difficult.

As disclosed in my previous U.S. Pat. No. 4,596,392 for a "Practice Ball For Golfers," a full golf swing may often be better practiced by driving an energy absorbing, deformable, powder-carrying practice ball against a vertical planar target. This is an apparatus requiring much less space than many other golf swing practice devices, although it fails to permit very accurate analysis of the results of one's technique.

SUMMARY OF THE INVENTION

The golf swing analyzer of the present invention enables a practicing golfer to execute a shot with an iron or a driver under conditions which very closely simulate a swing at a conventional golf ball. Once executed, the result of the shot may be analyzed by inspection of impact and rebound marks to determine with some precision both the accuracy of the shot, and the spin put on the ball.

Three main elements, in combination, are employed to this end. The first element is a teeing mat, preferably consisting of a patch of artificial grass or the like, upon which a ball tee is disposed for practicing shots with a wood or driver. Shots with irons may alternatively be made directly from the surface of the teeing mat, as one normally uses an iron while the ball is resting directly upon the grass surface of a golf course.

The second major element is a rigid, upstanding, target board disposed a convenient distance from the teeing mat, leaning slightly toward same, said target board bearing indicia such as the representation of a pin and flag at its center.

The third major element is a rebound board disposed substantially horizontally in front of the target board, said rebound board bearing reference indicia such as a center line.

The three major elements are used in conjunction with a moderately-resilient, energy absorbing practice golf ball such as that disclosed in my concurrently pending United States Patent Application, the serial number of which is presently unknown. Such a practice ball is able to carry marking powder on its surface so that upon being struck by a golf club it leaves a telltale trace of powder on the target board and the rebound board.

In use, a golfer places a practice ball on the teeing mat, perhaps, but not necessarily upon the ball tee, and addresses it as he wold a conventional golf ball. The golfer then drives the ball against the target board, leaving a powder mark on the board at the site of the ball's impact. Thereafter, the ball caroms off on a downward angle, striking the horizontal rebound board and leaving another powder mark. Finally, the ball rolls back to the vicinity of the teeing area.

By examination of the powder marks on the target board and rebound board the golfer may determine not only the raw accuracy of the shot, but also how much spin was put on the ball. If the accuracy and spin of the ball is found to be unacceptable, the golfer merely adjusts his or her stance, grip, pivot and other swing components in small increments accordingly to achieve the desired result.

All three main elements being essentially planar and of reasonable size, the apparatus is easily folded up and transported at will. Thus, it is an object of the present invention to provide a golf swing analyzer that is easily portable.

It is another object of the present invention to provide a portable golf swing analyzer that permits scrutiny of the result of a full-power golf swing executed in a relatively small space.

It is a further object of the present invention to provide a golf swing analyzer that with some precision is capable of illustrating the direction and amount of spin put on a practice ball.

It is yet another object of the invention to provide a golf practice device that permits a full-power swing to be executed and analyzed the results of such analysis being easily interpreted to suggest adjustments in a golfer's technique.

Still further objects of the inventive golf swing analyzer disclosed herein will be apparent from the drawings and following detailed description thereof.

DESCRIPTION OF THE PREFERRED EMBODIMENT

Figure 1:
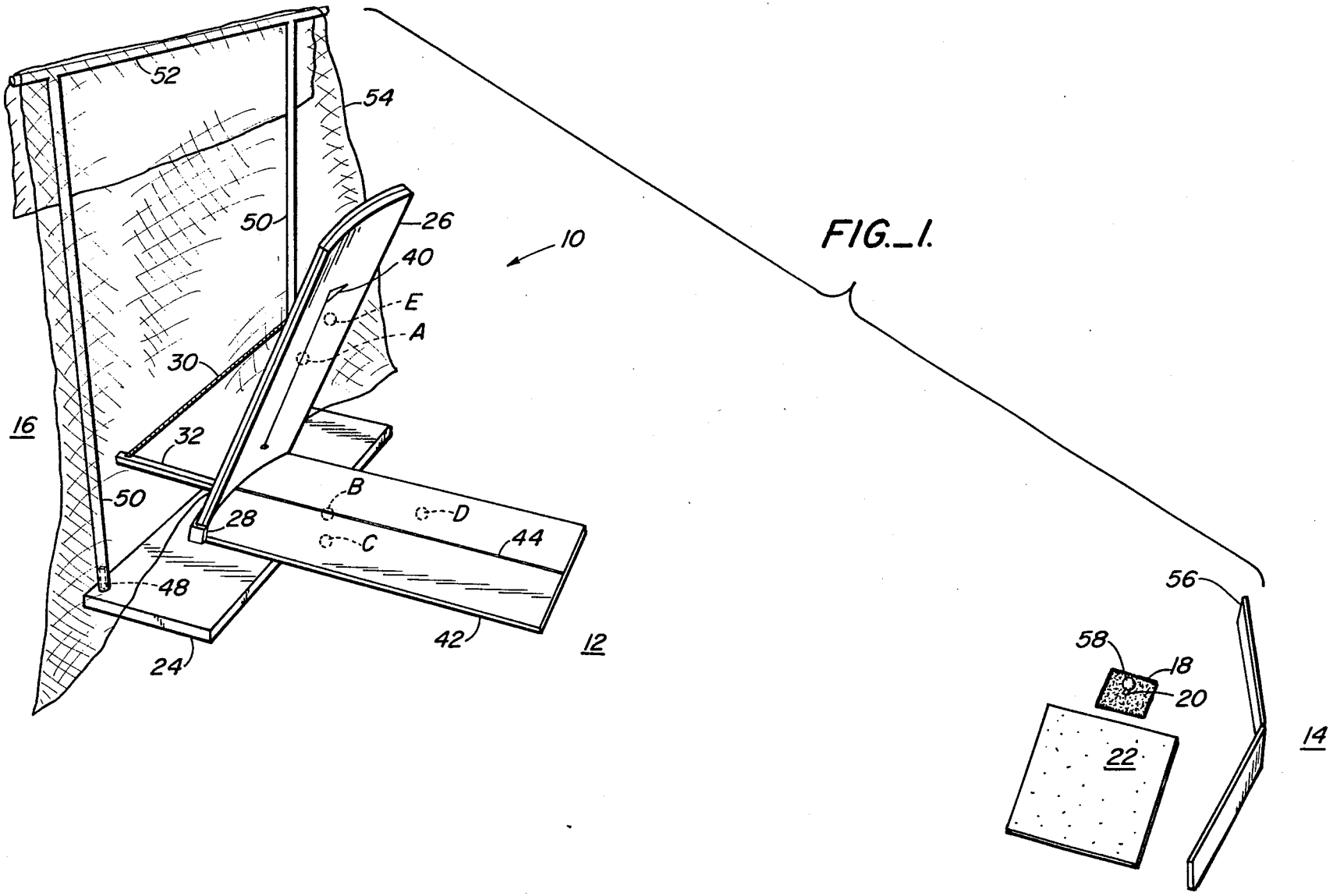
FIG. 1 is a perspective view of the inventive apparatus set up for use.
Figure 2:
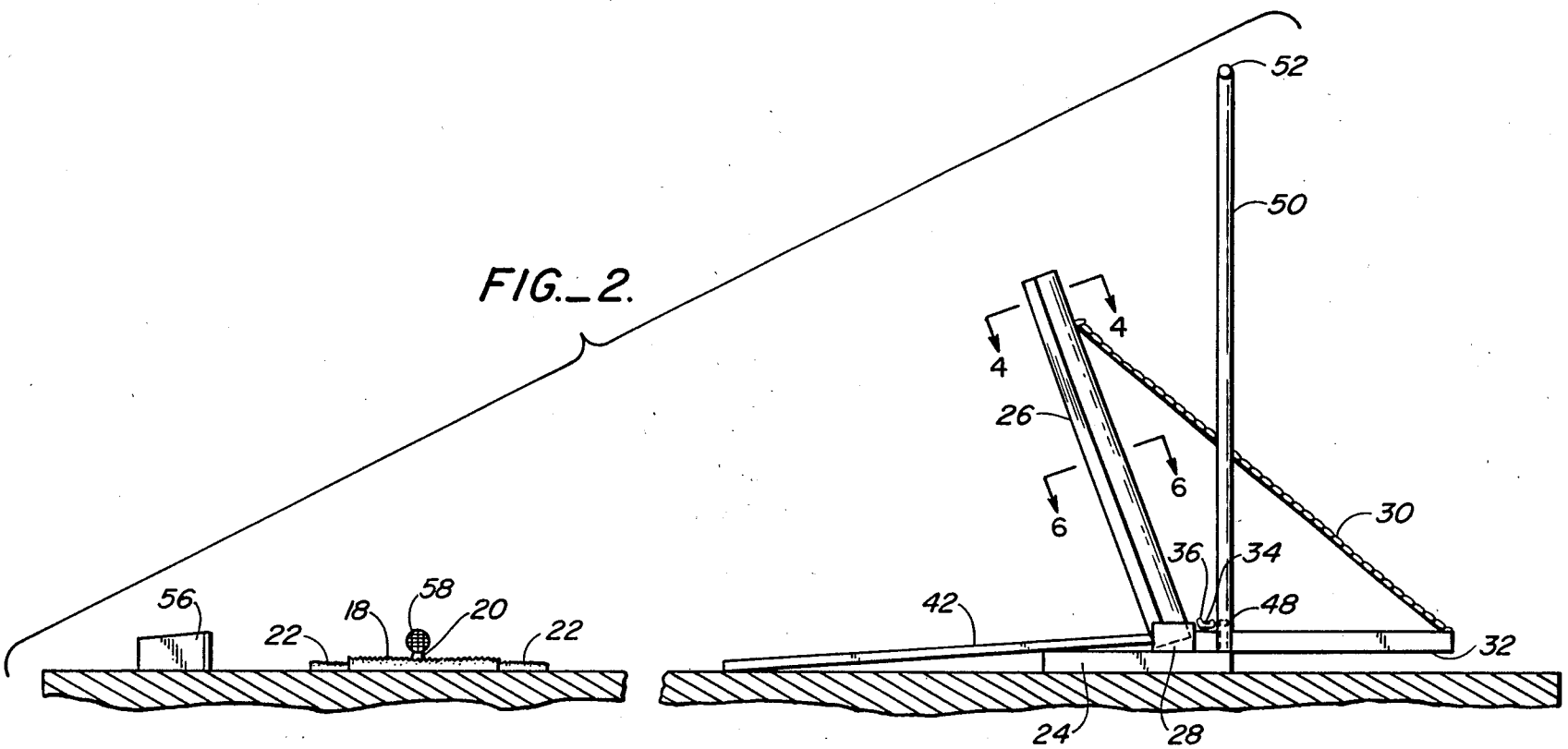
FIG. 2 is a side elevation of the apparatus of FIG. 1.
Figure 3:
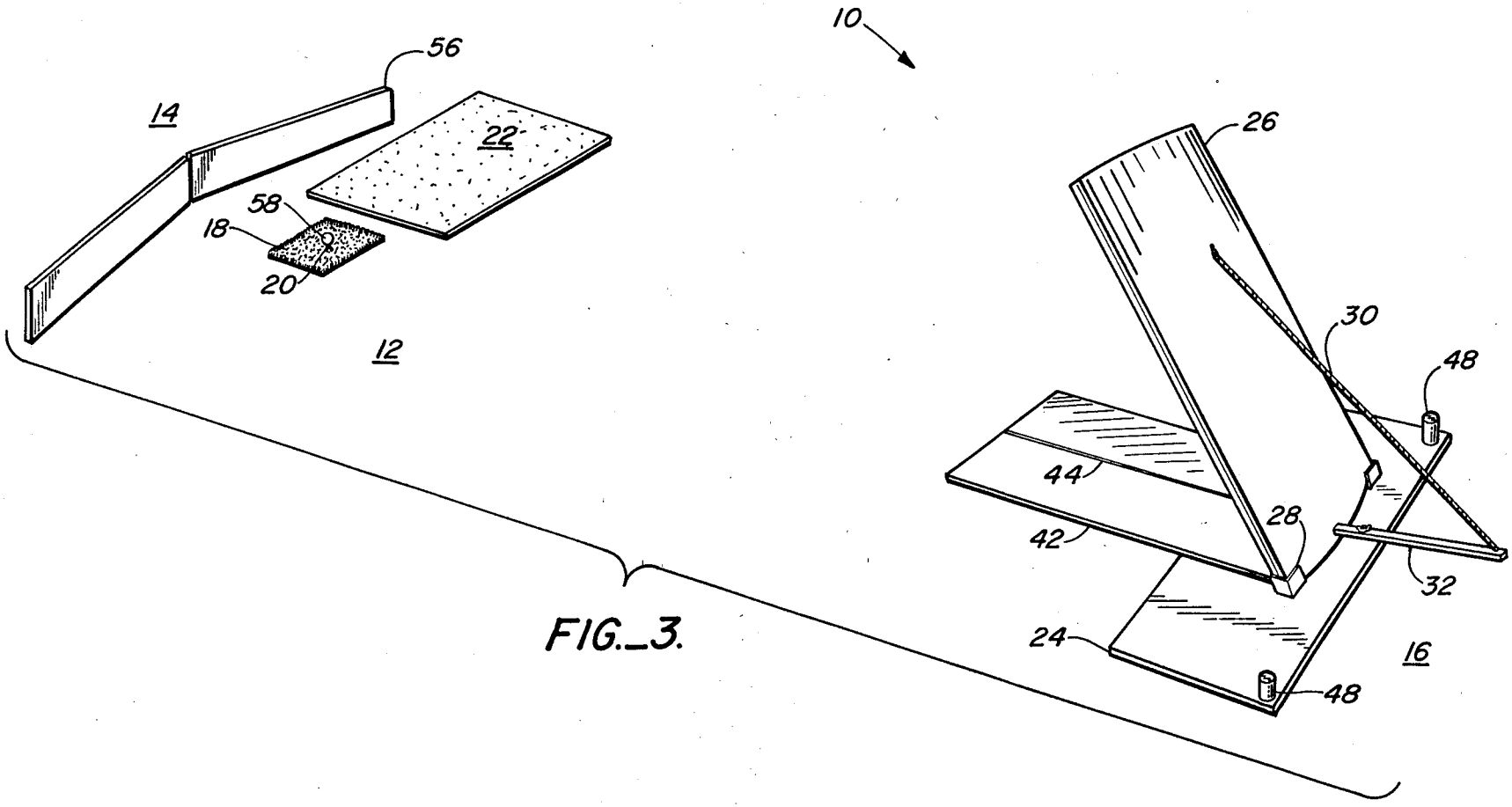
FIG. 3 is a perspective view from the distal end of the apparatus of FIG. 1 with the backstop sheet and its supports removed for clarity.

Referring now specifically to the drawings FIGS. 1, 2 and 3 show the preferred inventive golf swing analyzer indicated by reference numeral 10, disposed within an elongate area of firm level surface such as floor 12, defining a golf practice range. Said practice range has proximal and distal ends, 14 and 16 respectively.

Adjacent the proximal end 14 of the practice range, and disposed horizontally upon floor 12, is a teeing mat 18 preferably consisting of a rectangular patch of artificial grass, or the like. Said teeing mat 18 is of sufficient size to approximate that area of natural grass necessary to execute comfortably a proper golf swing. Further, disposed upon mat 18 is ball tee 20, one convenient embodiment of which is a short vertically oriented section of flexible tubing removeably bound to said mat 18.

Teeing mat 18 is preferably temporarily fixed to floor 12 with the aid of removeably adherent means such as two-faced tape, or the like, not shown.

Adjacent and laterally peripheral to teeing mat 18 is foot plant mat 22 consisting of a rectangular section of carpeting or the like suitable for a golfer to stand upon and properly plant his or her feet while addressing a practice golf ball on teeing mat 18. Foot plant mat 22 is preferably moveable to either side of teeing mat 18 to accommodate with equal comfort both right and left handed golfers. Foot plant mat 22 is preferably temporarily fixed to floor 12 with removeably adherent means such as two-faced tape, or the like, not shown.

At a comfortable distance, perhaps seven to eight feet, from teeing mat 18 near the opposite, distal end 16 of the practice range, a target base 24 comprising a stiff rectangular panel is horizontally disposed upon floor 12. Said base 24 is preferably constructed of a thick sheet of stiff, dense material such as wood or composition board for it serves several functions as explained below.

Upstanding upon the upper face of target base 24, a target board 26 rests in a generally vertical, but slightly proximally tipped, attitude. Means for holding target board 26 in a tipped attitude are described below.

Target board 26 is stiff, dense and preferably heavy enough to act as a relatively infinite mass in relation to a practice golf ball driven against it. Target board 26 is generally rectangular and preferably of enough vertical length to block substantially all practice golf shots made toward distal runner end 16 from teeing mat 18. And, board 26 is also preferably of enough horizontal width to block those same shots.

The lower extreme of board 26 is pivotally engaged with target base 24. Various means for engaging board 26 with base 24 may be envisioned, but the preferred engaging means comprises short, upstanding pieces of angle iron, or the like, forming brackets 28 which are fixed to the upper surface of base 24 and which receive the lower edge of target board 26. Said brackets 28 are oriented so as to prevent lateral and distal movement of the lower extreme of target board 26.

It will be realized by those skilled in the art that hinges or other functionally equivalent structures may be substituted for brackets 28 for pivotal attachment of target board 26 to target base 24. However, brackets 28 as shown and described are preferred because they permit the easiest disassembly of the golf swing analyzer 10 if it is to be folded up for storage or transport.

Target board 26 is held in a slightly tipped attitude toward teeing mat 18 by tether 30 which is preferably a chain, but may also be a cord, or the like. The proximal end of tether 30 is bound by any convenient means to the center of the upper distal face of target board 26, while tether 30's distal end is bound to fixed tether end securing means distal to said target board. The preferred fixed tether end securing means is an arm 32 protruding horizontally outward in a distal direction from the center of the upper distal edge of target base 24, said arm 32 having any convenient means at its distal end to receive and bind the distal end of tether 30. Tether 30 permits board 26 to pivot through a short arc from the vertical toward teeing mat 18.

Arm 32 preferably has a vertically oriented hole adjacent its proximal end through which a threaded stud 34, upstanding from target base 24, may pass thereby allowing arm 32 to pivot on stud 34. Said stud is centrally located with respect to the length of target base 24, and near its distal edge on its upper face. A nut 36 on stud 34 may conveniently bind arm 32 into its distally oriented position.

The angle at which target board 26 is proximally tipped is such that a line drawn from ball tee 20 to the center of the proximal face of board 26 would meet board 26 at substantially a right angle to its surface.

Figure 4:
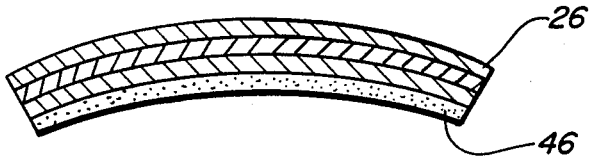
FIG. 4 is a sectional view taken along lines 4—4 of FIG. 2.
Figure 7:
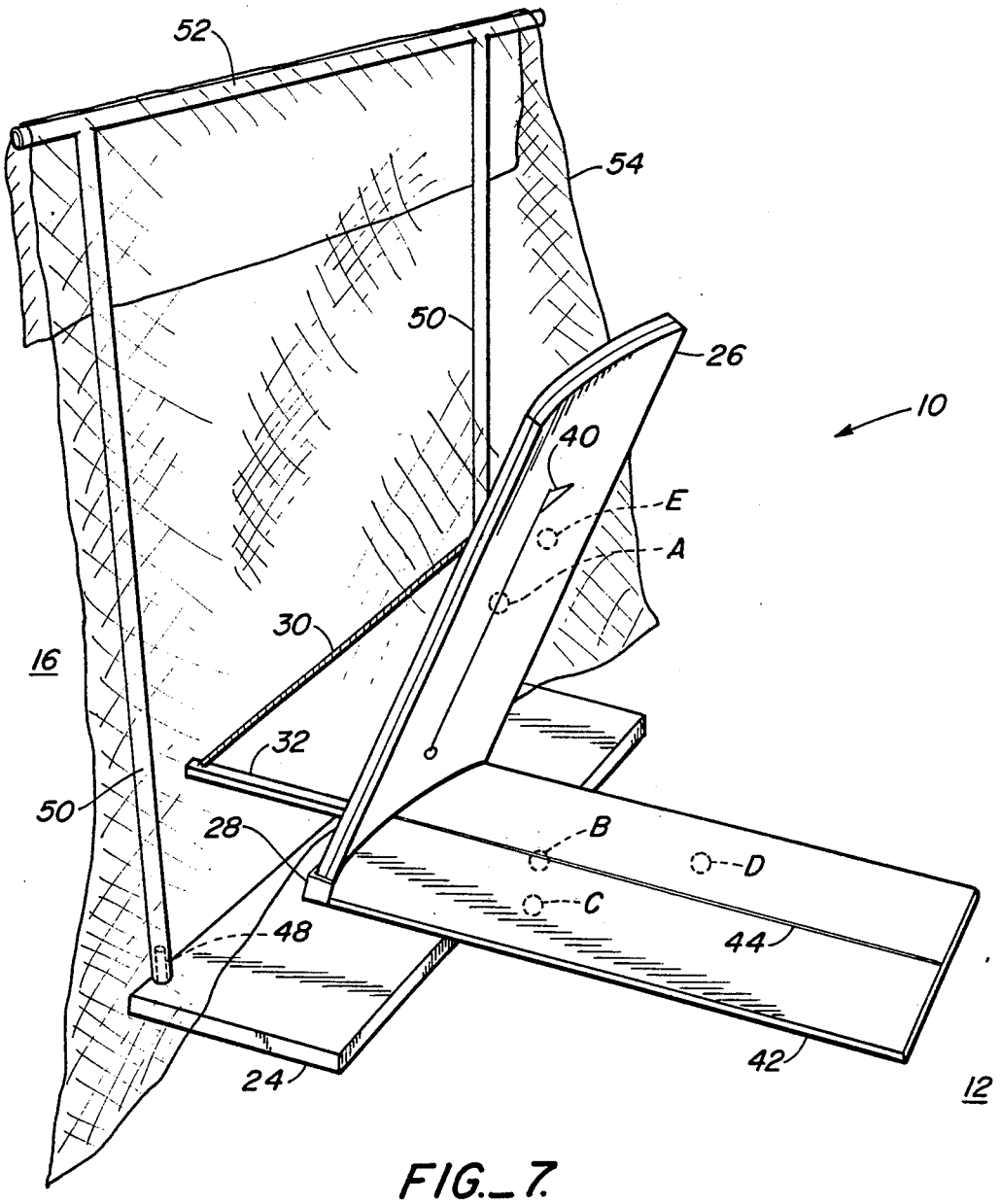
FIG. 7 is an enlarged perspective view of the target and rebound boards showing examples of powder marks to illustrate use of the apparatus for swing analysis.

As best shown in section in FIGS. 1 and 7, and in section in FIG. 4, the preferred embodiment of the present invention has a circular arc incorporated into the width of its target board 26, the focal point of said arc from midway up the proximally-tilted board being at ball tee 20. Said arc more particularly corresponds to that section of a circle lying between radii drawn from ball tee 20 to the midpoints of the two side edges of target board 26. Although a planar target board is adequate for practicing the essence of the present invention, one incorporating an arc permits more accurate analysis of practice shots, as appears more fully below in the context of an explanation of the invention's use.

Figure 5:
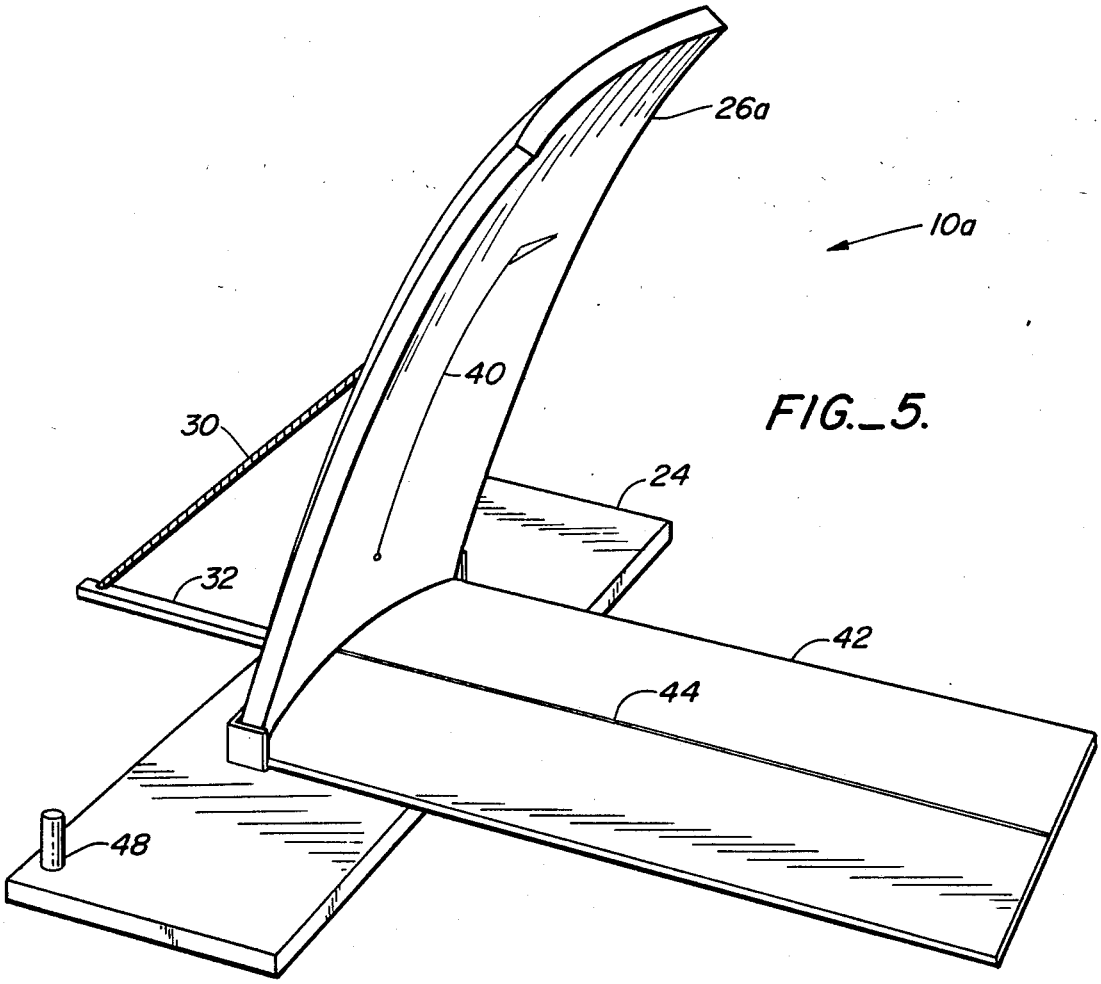
FIG. 5 is a perspective of an alternative target board resembling a section of a sphere to be used with the inventive apparatus.

As shown in FIG. 5, in an alternative embodiment of this device a second arc is incorporated into alternative target board 26*a*. Said second arc occurs along the length of target board 26*a*, thus causing target board 26*a* to describe a section of a sphere having its center at ball tee 20. The advantage of this configuration is also explained below in the context of a discussion of its use.

Figure 6:
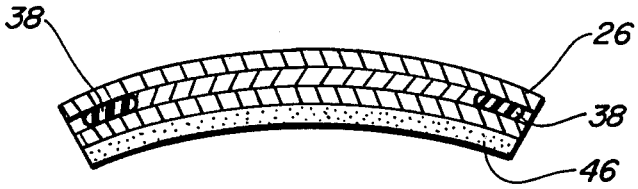
FIG. 6 is a sectional view of an alternative, peripherally-weighted target board taken along lines 6—6 of FIG. 2.

In a further alternative embodiment of target board 26 shown in section in FIG. 6, strips 38 of denser composition than the rest of the target board's materials are embedded in its two longer edges. Said strips 38 may be bound in place along the periphery of board 26 as it is built up by lamination. Lead or iron strips are expected to work well for this purpose, but other materials may also yield satisfactory results. A target board so constructed will resist the twisting motion normally caused when the board is struck peripheral to its vertical centerline by a practice ball. Such a peripherally-weighted target board's resistance to twisting is due to the inertial tendency of the weighted edges of the board to remain at rest. Limitation of such twisting assures deflection of a practice ball from the surface of target board 26 at the truest possible angle.

The proximal face of target board 26 preferably bears a central reference line such as pin 40 which is a representation of the pin and flag normally placed upright in the cup on a golf green.

Covering a portion of floor area 12 directly proximal to target board 26 and abutting the lower extreme of the proximal face thereof, a planar, generally rectangular, stiff sheet is substantially horizontally disposed for use as a rebound board 42. Said rebound board 42 may be constructed of wood, composition, or the like and is preferably of sufficient length and width to receive the secondary impact of substantially all practice balls that carom off target board 26. The surface of rebound board 42 is smooth and even, and in the preferred embodiment is longitudinally bisected by reference line 44 oriented in a proximal-distal direction.

To facilitate proper alignment of golf swing analyzer 10, the proximal surface of board 26 bears a clear reflective coating 46, preferably of acrylic, as shown in FIG. 4. Such a surface coating allows one to sight over ball tee 20 along reference line 44 on rebound board 42 to assure proper alignment with target board 26. The reflective coating 46 allows more precision in alignment of the analyzer, because by viewing the reflection of line 44 in coating 46 and confirming its alignment with pin 40 on the surface of target board 26, small corrections in the positions of the elements crucial to accurate spin analysis may be made.

As shown in FIGS. 1, 2 and 3, for the purpose of providing a backstop behind target board 26, there are placed on the outer distal corners of target base 24 two standard bases 48 supporting two upright standards 50. Standard bases 48 are comprised of short rods standing upright from the surface of target base 24. Standards 50 are preferably a pair of rigid tubular members constructed of plastic, or the like, and are of an inside diameter slightly larger than the diameter of the rods of standard bases 48, such that standards 50 may easily be slipped over the rods of bases 48 in a sleeve-like manner, thereby affording standards 50 upright support. Standards 50 are preferably of a height somewhat greater than the height of target board 26, and necessarily at least equal to the height of the highest stray golf shot likely to be made from teeing mat 18.

Between the upper termini of standards 50, and extending therebeyond for a short distance in both directions, is crossbar 52. Crossbar 52 is preferably of the same rigid tubular material as standards 50, and may be joined to the termini thereof in any conventional manner. The width of crossbar 52 is preferably such that it extends laterally at least to that furthest point by which a practice shot may miss target board 26 when driven from teeing mat 18.

To insure against practice balls passing over or beside target board 26 and causing damage or injury, a textile fabric backstop sheet 54 is disposed in hanging fashion over crossbar 52. Backstop sheet 54 is generally rectangular and necessarily of sufficient vertical dimension to hang from crossbar 52 to floor 12, and of sufficient horizontal dimension to cover the area between the termini of crossbar 52. Textile fabric is preferred over conventional netting because its tightly woven structure more effectively stops stray shots made with such practice balls as are preferred to be used herein. Thus, backstop sheet 54 forms the distal boundary of the playing area of golf swing analyzer 10.

Cooperating with backstop sheet 54's action as a distal boundary is roll stop 56 acting as a proximal boundary to the playing area of golf swing analyzer 10. Said roll stop 56 preferably comprises a pair of rectangular planks standing on edge at the extreme proximal end 14 of the practice range, serving to stop practice balls from rolling beyond the reach of the practicing golfer upon their rebound from the distal end of the swing analyzer 10.

In use, the elements described above cooperate as follows. A practicing golfer first coats the surface of the preferred resilient, low-energy practice ball 58 with powder. The golfer then places practice ball 58 either in a raised position upon the ball tee 20, or directly upon the teeing mat 18. With his or her feet planted squarely upon foot plant mat 22, the golfer addresses ball 58 as if preparing to strike a conventional golf ball in regular play.

In lining up the shot, the golfer aims along reference line 44 at pin 40 on the surface of target board 26. The golfer then swings at the ball causing powder to be dislodged upon the face of the target board upon the ball's impact. Thus, a first powder mark has been created for reference and analysis. The ball then caroms off target board 26 on a downward angle toward rebound board 42 and leaves a second powder mark at its point of impact. Finally, as the ball loses its remaining momentum it rolls back to rest in the area near the teeing mat 18. If, perhaps, the ball was struck with greater than average force, it may continue past the teeing mat to rebound softly off roll stop 56, thereby keeping the ball within easy reach of the golfer. The golfer then "reads" the powder marks, as explained below, before wiping them off with a cloth and preparing for another shot.

Examination of the relative placement of the powder marks reveals the raw accruacy and amount of spin on the ball. For a first example if, as shown in FIG. 7, the powder mark on target board 26 is found at position "A" and the powder mark on rebound board 42 is found at position "B," two conclusions are warranted. First, the ball was hit with raw accuracy, straight along center reference line 44, thereby leaving powder mark "A" superimposed upon pin 40 on target board 26. Second, it is clear that the ball was hit without any side spin, as can be determined by noting that powder mark "B" is superimposed upon reference line 44. That is, there was no left or right spin on the ball when it hit the center line of target board 26, and therefore it was not deflected to the right or left of reference line 44. In summary, the shot had perfect raw accuracy, and lacked wayward spin to either side.

Assume, for a second example, that powder marks "A"and "C" remained after a shot. It could be determined that, although the shot had raw accuracy and hit the center pin 40 on target board 26, it also had left spin that deflected it to the left of reference line 44 when it caromed off the target board. Such spin would cause a conventional golf ball to "slice" in regular play if the golfer was right-handed. The displacement distance of mark "C" from reference line 44 bears a relationship to the amount of spin and, therefore, the severity of the slice. Right spin could yield a mark such as "D" to the right of reference line 44. This would correspond to a "hook."

Such calculations as have just been explained, wherein the ball has raw accuracy and first strikes the center of the target board, may be accomplished with a target board of planar configuration as well as a curved target board. However, a curved target board is required for analysis of shots that do not have raw accuracy because calculation of the spin on such shots requires that the natural deflection of the target board be toward the tee.

For example, assume that ball 58 first hits target board 26 off-center and leaves a powder mark at "E." If the shot was merely hit inaccurately with respect to reference line 44, but had no left or right spin, it could be expected to leave a mark on the rebound board such as "D" falling within the vertical plane shared by ball tee 20 and powder mark "E."However, if left spin is imparted to the ball, a mark on rebound board such as "B" or "C" may expected, depending upon the severity of the spin. Essentially, any mark on the rebound board 42 found to be outside the vertical plane shared by ball tee 20 and mark "E" would indicate that spin had caused such deflection. As above, the amount of deflection corresponds to the amount of spin.

It is also helpful to know the amount of backspin put on a shot so a practicing golfer may work toward its control. With a planar target board, or a target board with an arc across its width, shots with the same amount of backspin will leave marks in different places on the rebound board depending upon the velocity and the height at which they first strike the target board. Assuming velocity can be controlled, the height of impact is still a problem with a target board that is straight along its length because the direction of deflection varies along the vertical length of the board. Thus, the relative amount of backspin on two shots may only be compared if they happen to hit the target board at the same height. If indeed they did have the same backspin, they would leave marks on the rebound board at the same distance from the base of the target board.

If the practicing golfer is able to control the velocity of a shot to some degree, alternative target board **26*a* may provide a viable tool for analysis of backspin. As seen in FIG. 5, and explained above, target board 26*a* is shaped as a section of a sphere having its center at ball tee 20. Thus, the natural line of deflection of a shot without spin, from all points on the face of target board 26*a*, is toward ball tee 20. This is so no matter the height of the point of contact with the face of the target board. Therefore, as long as a golfer can control the velocity variable, making it equal in two shots to be compared, the relative backspin on the shots may be assessed by comparison of the powder marks left on rebound board 42. If the powder marks are the same distance from the base of target board 26*a***, then their backspin was also the same, even if they struck the target board at different heights.

Upon completion of a practice session, a golfer can easily disassemble the golf swing analyzer and arrange it in a relatively small package for transportation or storage. Later, it can just as easily be set up indoors or outdoors for another practice session.

The foregoing detailed disclosure of the inventive golf swing analyzer 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this golf swing analyzer may later be realized. Accordingly, the scope of the invention should be determined with reference to the appended claims, and not by the examples which have herein been given.

What is claimed is:

1. A golf swing analyzer for use on an elongated level surface defining a practice range, said range having proximal and distal ends, comprising in combination:

a. tee means disposed upon said surface at the proximal end of said practice range;

b. a target board disposed at the distal end of said range comprising a rigid, upstanding, substantially rectangular panel;

c. a rebound board comprising a rigid, substantially rectangular panel disposed generally horizontally upon said level surface between said tee means and said target board; and, d. means for holding said target board at a selected angle of tilt toward said tee means, whereby a powder-carrying practice golf ball may be driven from said tee means to strike said target board and sad rebound board in succession leaving powder marks susceptible to analysis.

2. The golf swing analyzer of claim 1, wherein said target board holding means comprises:

a. a target base comprising a dense, rigid panel disposed horizontally upon said surface;

b. means for engaging the lower edge of said target board with the upper face of said target base such that said target board may be tilted toward said tee means.

c. a tether having its proximal end secured to the distal face of said target board, and its distal end secured to fixed tether end securing means distal to said target board.

3. The golf swing analyzer of claim 2, wherein fixed tether end receiving means comprises an arm connected to and projecting distally from said target base, said arm having means at its distal end to secure said distal tether end.

4. The golf swing analyzer of claim 1, wherein said target board is tilted sufficiently toward said tee means such that a straight line from said tee means meets the center of said target board's proximal surface at substantially a right angle.

5. The golf swing analyzer of claim 1, wherein said target board is curved across its width, said curve at half said board's height defining a section of a circle having its center at said tee means.

6. The golf swing analyzer of claim 1 wherein said target board is curved both across its width and along its length, causing said target board to represent a section of a sphere having its center at said tee means.

7. The golf swing analyzer of claim 1, wherein said target board is weighted along its vertical edges.

8. The golf swing analyzer of claim 1, wherein said tee means comprises a mat capable of receiving a golf ball support upon its upper face.

9. The golf swing analyzer of claim 8, wherein said mat is a patch of artificial grass.

10. The golf swing analyzer of claim 1, including a foot plant mat disposed beside said tee means.

11. The golf swing analyzer of claim 1, wherein said target board bears a vertically-oriented reference line upon the center of its proximal face.

12. The golf swing analyzer of claim 1, having a backstop distal to said target board.

13. The golf swing analyzer of claim 1, wherein said rebound board bears a central reference line in proximal-distal orientation upon its upper face.

14. The golf swing analyzer of claim 1, wherein said target board bears a clear, reflective coating on its proximal face.

15. The golf swing analyzer of claim 14, wherein said coating is acrylic.

16. The golf swing analyzer of claim 1, including a roll stop at the proximal end of said range, said roll stop comprising at least one upstanding generally rectangular plank of sufficient height to stop a rolling practice golf ball.

17. A portable golf swing analyzer kit for use on an elongated level surface in a limited space defining a practice range, said range having proximal and distal ends, comprising in combination:

a. tee means removeably adherable to said surface at the proximal end of said practice range;

b. a rigid, substantially planar target disposed upon a base and tilted toward said tee means at the proximal end of said range when said base is placed on said level surface at the distal end of said range; and, c. a rigid, planar rebound board adapted to disposed upon said level surface between said tee means and said target board for receiving and being marked by a powder-carrying practice golf ball driven from said tee means and rebounding from said target.

18. The golf swing analyzer kit of claim 17, wherein said target is curved across its width, said curve at half the height of said target defining a section of a circle having its center at said tee means.

19. The golf swing analyzer kit of claim 18, wherein the proximal surface of said target and the upper surface of said rebound board bear central reference lines.

20. A golf swing analyzer for use on a level surface comprising, in combination:

a. a resilient, powder-carrying practice golf ball;

b. tee means on said surface for presenting said ball in a ready position for a practice sot;

c. a rigid, substantially planar target spaced apart form said tee means on said surface and tilted toward said tee means; and, d. a rigid, planar rebound board disposed between said tee means and said target on said surface, whereby said ball may be driven by a practicing golfer from said tee, against said target, to carom against said rebound board and thereby leave powder marks from which an analysis of the golfer's swing may be conducted.

* * * * *